United States Patent [19]

Baumann et al.

[11] 4,420,895

[45] Dec. 20, 1983

[54] SKI BOOT

[76] Inventors: Peter Baumann, Gaswerkstr. 13, D-7768 Stockach; Lutz Biedermann, Am Schäfersteig 8, D-7730 Villingen, both of Fed. Rep. of Germany

[21] Appl. No.: 171,390

[22] Filed: Jul. 23, 1980

[30] Foreign Application Priority Data

Jul. 27, 1979 [DE] Fed. Rep. of Germany ..... 2930648
Apr. 1, 1980 [DE] Fed. Rep. of Germany ..... 3012716

[51] Int. Cl.[3] ..... A43B 5/04
[52] U.S. Cl. ..... 36/118
[58] Field of Search ..... 36/109, 118; 2/22

[56] References Cited

U.S. PATENT DOCUMENTS 3,928,872 12/1975 Johnson ..... 38/118

FOREIGN PATENT DOCUMENTS 14124 1/1980 France ..... 36/118

*Primary Examiner*—Patrick D. Lawson
*Attorney, Agent, or Firm*—Donald Brown

[57] ABSTRACT

A ski boot comprising a boot part to receiver a wearer's foot and a leg engaging part which extends upwards from and is hinged to the boot part at a hinge point, said leg engaging part being shaped and positioned so as to at least partially grip around the knee joint of the wearer.

9 Claims, 8 Drawing Figures

FIG. 4
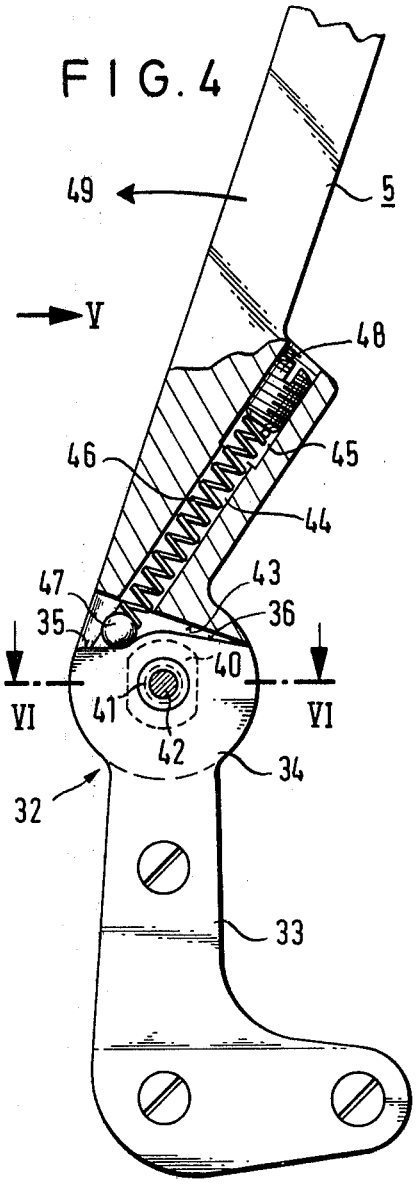
FIG. 5
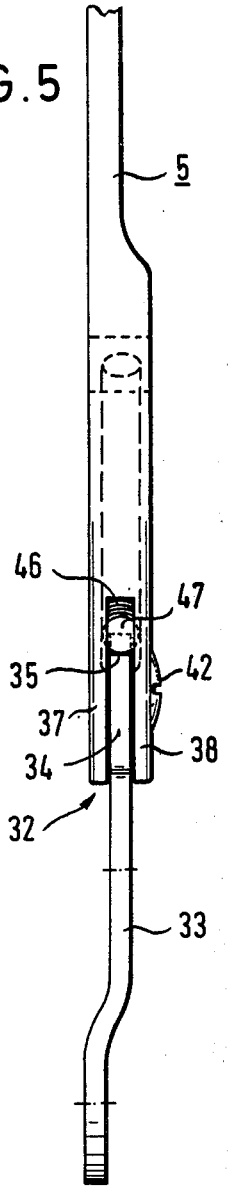
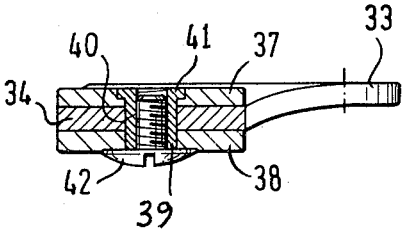
FIG. 6

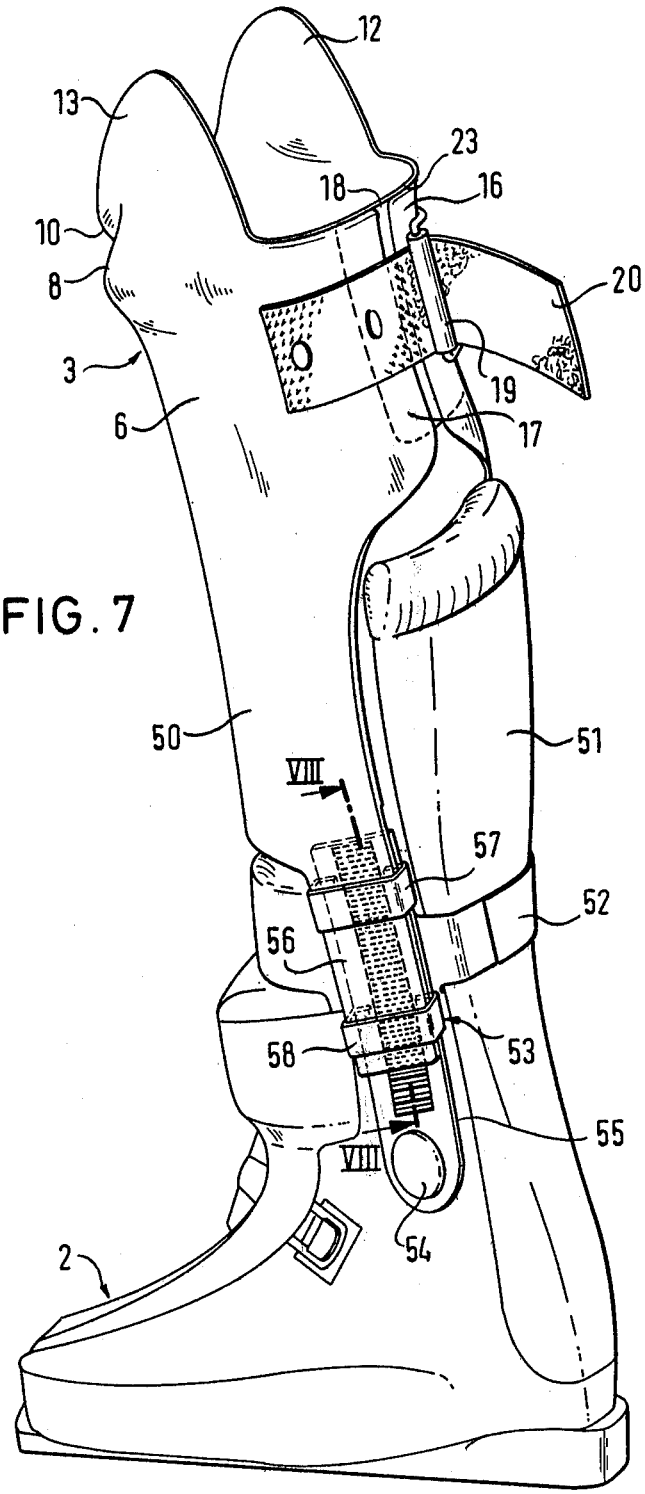
FIG. 7
FIG. 8
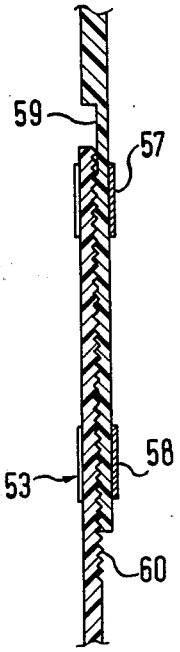

SKI BOOT

DESCRIPTION

The invention relates to a ski boot having a boot part to receive the foot of a wearer and a leg engaging part which extends upwards therefrom and is hinged to the boot part.

The specification of German Patent Application No. 2,316,443, as published on acceptance, discloses a ski boot which can be hingedly attached to the lower leg below the knee joint by means of a lever and a fixing device connected to a boot part. In this way, the biomechanical lever action when the ankle is pivoted is displaced into the upper third of the lower leg. However, this arrangement does not achieve an improvement in the muscular action, because the muscles, which stabilise the ankle joint are still stressed, with such a boot, in the same way as they are in the case of a ski boot without any such leg engaging arrangement.

The object of this invention is to provide a ski boot having a leg engaging part, by means of which the biomechanical lever conditions at the ankle in respect of axes corresponding to the longitudinal and transverse axes of the ski are improved. The aim is that stress on muscles and bones be diminished and skiing be thus made easier and safer.

According to the present invention there is provided a ski boot comprising a boot part to receive a wearer's foot and a leg engaging part which extends upwards from and is hinged to the boot part at a hinge point, said leg engaging part being shaped and positioned so as to at least partially grip around the knee joint of the wearer.

By reason of the leg engaging part gripping the wearer's knee, much improved support and protection against muscular, joint or bone damage is achieved.

Further features and advantages of fhe invention can be appreciated from the following description of exemplary embodiments given with reference to the accompanying drawings in which:

FIG. 4 shows an embodiment of hinge mechanism for joining the boot part and the lever of the leg part, partially in a broken representation;

FIG. 5 is the detail shown in FIG. 4 in side view in the direction of the arrow V of FIG. 4;

FIG. 6 shows the detail shown in FIG. 4, along the line VI—VI;

FIG. 7 is a perspective overall view of a further embodiment of ski boot of the invention; and FIG. 8 is a section along the line VIII—VIII of FIG. 7.

Figure 1:
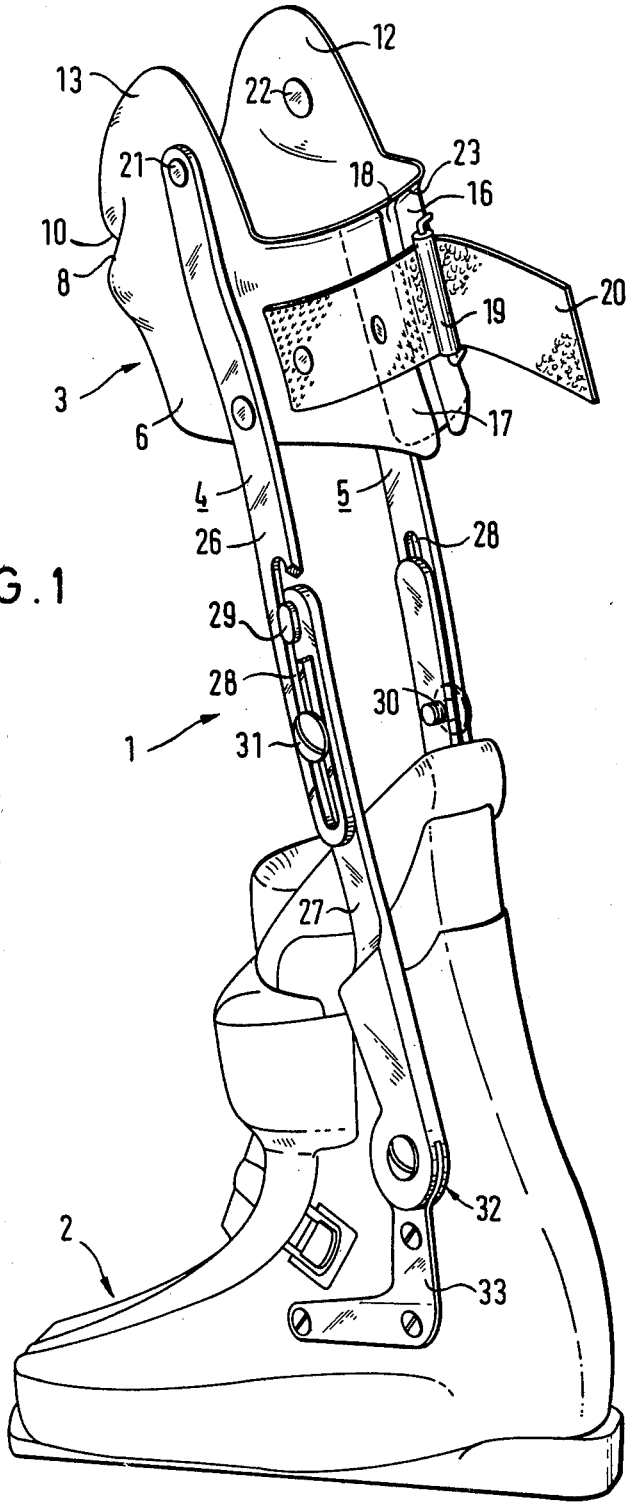
FIG. 1 is a perspective overall view of a ski boot of the invention.

As can best be seen from FIG. 1, the ski boot 1 of the invention comprises a boot part 2 to receive the wearer's foot and a leg engaging part in the form of a knee grip 3 which is joined to the boot part 2 by means of two levers 4 and 5.

Figure 2:
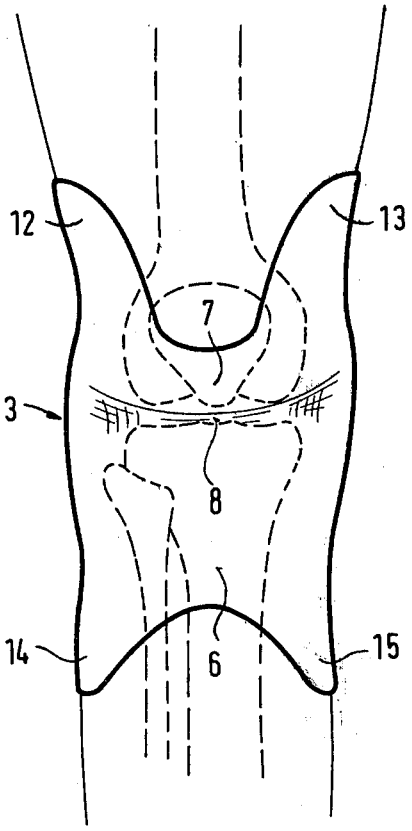
FIG. 2 is a front view of the grip around the knee of the boot of FIG. 1.
Figure 3:
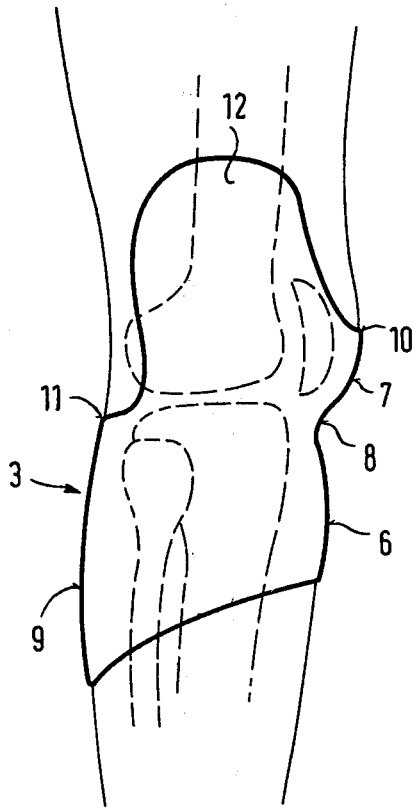
FIG. 3 is a side view of the grip around the knee.

The knee grip 3, as shown in FIGS. 2 and 3 comprises a shell-like body which, at its front, has a lower zone 6 which grips around the front tibial muscles directly below the knee, an upper zone 7 which extends upwards over the kneecap to about one third of the height thereof and has an upper edge 10, and, between zones 6 and 7, an interposed central zone 8. The central zone 8 is shaped in the form of a segment of a ring in such a way that an inward-extending convex part bears against the quadriceps tendon.

On its rear, the shell-like body has a zone 9 which is opposed to the front zones 6, 7 and 8 and of which the shape is adapted to the rear muscles of the lower leg and the size is such that the upper edge 11 does not hinder bending of the knee. The zone 9 extends downwards for such a distance that its area is approximately equal to the combined area of the zones 6,7 and 8.

The shell-like body 3 has lateral support zones 12 and 13 which extend upwards at respective sides from the front edge 10 and rear edge 11 and lateral zones 14 and 15 extending downwardly, also at the sides, for a rather smaller distance.

The exact shape of the shell-like body is determined by the anatomical conditions of the knee region, the individual zones described being selected in such a way that dorsal contact support of the knee joint is provided from the front by the zones 6,7 and 8, and contact support of the rear muscles of the lower leg is provided by the rear zone 9 which serves as a counter-support for the zones 6, 7 and 8. The support zones 12 and 13 which extend laterally upwards in the front part beyond the upper zone 7, extend upwards for such a distance that they laterally and medially support the condylus of the femur. In the lower part, the lateral support zones 14 and 15 extend so far downwards that the support surface 14 is supported on the head of the fibula and the support surface 15 is suported on the condylus of the tibia.

In the rear zone 9, the shell-like body is split in the vertical direction (see FIG. 1) into portions 16 and 17. On the inside of portion 16 is provided a lug 18 extending under the other portion 17. A fixing device 20 consisting of a buckle 19, which is fixed to one portion, and a buckle strap 20 on the other portion is provided. The buckle and strap can be provided in the form of a simple touch-and-close fastener. Preferably, the shell-like body 3 is formed from a plastics material of such a type that it has the necessary strength required for giving support while being sufficiently elastic to enable the two half portions 16 and 17 to be moved apart so as to be positioned around the knee region when the ski boot is put on. The knee grip is then securely fixed around the knee by tightening the buckle strap. As can be seen, particularly from FIG. 1, the upper front edge 10 and the rear upper edge 23 are slightly bent outwards, so that a risk of injury is eliminated.

The knee grip 3 is firmly joined to the upper ends of the levers 4 and 5 with the aid of pairs of rivets 21 and 22. To enable the knee grip 3 to be brought into the correct support position for any particular length of leg, the levers have a length adjustment device. This can be a bayonet device while in the embodiments shown, each lever has an upper arm 26 and a lower arm 27 with a guide slot 28 provided at the lower end of the upper arm. A nose-shaped projection 29 is provided at the upper end of the lower arm 27 and slides in the guide slot 28 while below that is a threaded hole 30 into which extends a screw 31 which engages through the guide slot 28 and which can lock the lever at a set length. The slot in the screw 31 is advantageously chosen so that the screw can be tightened, for example, with the aid of a coin. Any other length adjustment device can, however, also be used, the important points being that the adjustment can be easily carried out by the skier, if possible without a special tool, and that the risk of injury should be minimised.

At their lower ends, the two levers 4 and 5 are each joined to the boot part 2 via a spring-loaded hinge mechanism 32. The details of this can best be seen from FIGS. 4 to 6. The spring-loaded hinge mechanism is formed of a L-shaped fixture part 33, which can be rigidly joined to the boot part, and by the lower part of the particular lever 4,5. At its upper end, the fixture part 33 has a part 34, in the form of a segment of a circle, with a central bore. The upper edge of the fixture part is shaped so that it forms an almost horizontal abutment surface 35 at the rear, as viewed in the direction of the wearer, and a stop surface 36 at the front. The lower end of the lever 4 or 5 is bifurcated, with two limbs 37, 38 in sliding contact with the outer surfaces of the part 34 and in the form of a segment of a circle. The arms have corresponding central bores aligned with that in the part 34. In the limb 37 which is to be adjacent the boot, there is an elongate blind hole coaxial with the bores through part 34 and limbs 37, 38. This can be seen in FIG. 4, while FIG. 6 shows a bearing 39 inserted into the elongate hole and the bores. The bearing 39 has a portion 40, of circular cross section and a shaped end 41 corresponding to the elongated hole to prevent it rotating. The lever 4 or 5 is thus pivotably connected to the fixture part 33 by means of a screw 42 extending through the bearing 39. At their lower front ends the levers 4 and 5 have, between the limbs, a stop surface 43, by means of which their forward inclination from the vertical is limited by the stop surface 36.

As again best shown in FIGS. 4 and 5, the levers 4 and 5 each have an inclined hole 44 extending towards the abutment surface 35 and having a threaded zone 45 remote from the abutment surface 35. To provide resilient pretensioning, there is provided in the sloping hole 44 a compression spring 46, the lower end of which rests on a ball 47 which is in contact with the abutment surface 35 and with the limbs 37 and 38. The upper end of the compression spring 46 bears against an adjustment screw 48 in the sloping hole 44. This ensures that the particular lever 4, 5 is pivotable in the direction of the arrow 49 against the action of the spring and tends to move back into the position shown in FIG. 4 when the force is released.

In the illustrative embodiment described above, the inner and outer levers 4 and 5 extend directly upwards from the spring-loaded hinge mechanism 32 to the knee grip 3. It is also possible, if desired, to displace at least the inner lever 5 towards the rear, but it will still be essential that the mechanical pivot, formed by the spring-loaded hinge mechanism 32, is aligned with the anatomical pivot of the ankle joint, in the same way as in the case of the embodiment described above.

FIG. 7 shows an embodiment of a ski boot which, in the lower boot part 2 and the upper part 3 forming the knee grip, is identical in many respects to the embodiment already described. Identical parts are indicated by the same reference numerals.

However, in the embodiment of FIG. 7 the knee grip 3 is formed integrally with a front leg part 50, while a rear leg part 51 extends upwards from the boot part over the calf to a point just below the knee grip 3. The rear leg part 51 is joined to the front leg part 50 in the conventional manner in such a way that they can be forced apart at the rear so that the user can step into the boot from behind, can tilt the rear leg part of the boot into the closed position as shown in the Figure and can then lock the parts firmly together by means of a device 52. With this embodiment the shin is additionally protected.

The leg part 50 is connected to the boot part 2 via a pivot joint 54 the pivot again being located at the height of the anatomical pivot of the ankle joint. The device for generating the resilient pre-tensioning can also be provided in the same way as in the first embodiment.

Since, in this second embodiment, the knee grip 3 should also be adaptable as exactly as possible to the anatomical details of the user, a length adjustment device 53 is again provided between the leg part 50 and the pivot joint 54. As can best be seen also from FIG. 7, an arm 55 extending from the pivot joint 54 is rigidly joined by means of clamping jaws 57 and 58 to an arm 56 extending downwards from the leg part 50. On their mutually facing sides 59 and 60, the arms 55 and 56 have serrated surfaces of the same form so that they mutually engage, in the manner shown in FIG. 8, when they are placed against each other. To adjust the distance of the knee grip from the pivot 54, and hence to adjust the height of the knee grip above the boot part, the clamping jaws 57 and 58 are opened, the respective arms on both sides of the boot are placed against each other so that the knee grip is at the correct position, and the joint is then locked again by means of the clamping jaws. Of course, a screwed joint can also be used in place of the clamping jaws.

With the above described embodiments of ski boot, a dorso-ventrad support of the bones and soft parts is achieved which permits flection-extension in the knee joint and supports the lower leg at a level above the articular space of the knee. The semi-rigid connection to the boot part increases support in the longitudinal and transverse directions. The lateral fixing stabilises the knee joint in the region of the transverse knee axis against lateral rotational movements which may be caused by leverage across the longitudinal axis of the ski. The rigid connection to the ski and boot part unit prevents pronating and supinating movements in the talocalcaneal joint and transmits these movements to the side. The important point is that the mechanical pivot formed by the spring-loaded hinge mechanism 32 is located at the height of the anatomical pivot of the ankle joint, so that only bending and stretching, but no torsion, are possible in the ankle joint. The bending and shearing forces are transferred to the thigh bone. Moreover, a lateral stabilisation of the transverse knee axis against rotational and shearing movements of the longitudinal axis of the ski is achieved.

We claim:

1. A ski boot comprising a boot part to receive a wearer's foot and a leg engaging part which extends upwards from and is hinged to the boot part at a hinge point, said leg engaging part being shaped and positioned so as to at least partially grip around the knee joint of the wearer.

2. A ski boot as claimed in claim 1, wherein said leg engaging part is shaped to be supported on at least one of the medial and lateral condyli of the knee joint.

3. A ski boot as claimed in claim 1 wherein said leg engaging part is shaped to extend upwards beyond the articular space of the knee of the wearer.

4. A ski boot as claimed in claim 1, wherein the leg engaging part has a zone in the form of a segment of a ring to grip around the quadriceps tendon of the wearer.

5. A ski boot as claimed in claim 1 wherein the leg engaging part has zones to be supported in at least one of the lateral and medial directins on the condylus of the femur of the wearer.

6. A ski boot as claimed in claim 1 wherein the leg engaging part has a contact support zone to bear against the rear muscles of the lower leg of the wearer.

7. A ski boot as claimed in claim 1, including means to adjust the distance between said hinge point and the leg engaging part.

8. A ski boot as claimed in claim 1 including resiliently yielding means at the hinge point between the leg engaging part and the boot part.

9. A ski boot as claimed in claim 1 including a leg of the boot integral with the leg engaging part, said leg being pivotally connected to said boot part of said hinge point.

* * * * *